US005096412A

United States Patent [19]

Lanza et al.

[11] Patent Number: 5,096,412

[45] Date of Patent: Mar. 17, 1992

[54] COMBUSTION CHAMBER FOR MULTI-FUEL FIRED OVENS AND GRIDDLES

[75] Inventors: Richard J. Lanza, Leominster; Robert G. Bernazzani, Franklin, both of Mass.

[73] Assignee: The United States of America as represented by the Secretary of the Army, Washington, D.C.

[21] Appl. No.: 645,973

[22] Filed: Jan. 28, 1991

[51] Int. Cl.[5] ..... F23R 3/00

[52] U.S. Cl. ..... 431/158; 431/351; 60/752

[58] Field of Search ..... 431/158, 351, 10; 60/752

[56] References Cited

U.S. PATENT DOCUMENTS

| | | | |
|---|---|---|---|
| 2,654,219 | 10/1953 | Zaba | 60/752 |
| 3,376,098 | 4/1968 | Pryor | 431/158 |
| 3,730,668 | 5/1973 | Iida et al. | 431/158 |
| 3,836,315 | 9/1974 | Shular | 431/9 |
| 3,923,251 | 12/1975 | Flournoy | 239/402.5 |
| 3,998,581 | 12/1976 | Hemingway et al. | 431/158 |
| 4,023,921 | 5/1977 | Anson | 431/9 |
| 4,094,625 | 6/1978 | Wang et al. | 431/9 |
| 4,240,784 | 12/1980 | Dauvergne | 431/351 |
| 4,437,831 | 3/1984 | Brooker et al. | 431/177 |
| 4,575,332 | 3/1986 | Oppenberg et al. | 431/9 |
| 4,830,604 | 5/1989 | Korenberg | 431/158 |

*Primary Examiner*—Carroll B. Dority

*Attorney, Agent, or Firm*—Richard J. Donahue

[57] ABSTRACT

A combustion chamber and burner apparatus designed to accept multiple types of liquid fuel for use in ovens and griddles including an outer chamber and an inner chamber. The outer chamber includes an air input conduit at one end and a fluid delivery conduit at the opposite end. The inner chamber is disposed in spaced relationship within the outer chamber, and the air carried by the input conduit is caused to pass over the inner chamber for heat exchange purposes. The products of combustion produced in the inner chamber are mixed with the air passing over the inner chamber in the vicinity of the fluid delivery conduit at the opposite end of the outer chamber. The inner chamber includes a burner assembly including fuel delivery means, a flame retention head and means for moving a quantity of air past the head to shape the burner flame into a tear-drop shape so as to control the flame intensity and thereby the temperature of the substance delivered to the griddle.

1 Claim, 2 Drawing Sheets

COMBUSTION CHAMBER FOR MULTI-FUEL FIRED OVENS AND GRIDDLES

BACKGROUND OF THE INVENTION

1. Field of the Invention

This invention relates to an improved combustion chamber for burning a variety of fuels, and more particularly to a combustion chamber and burner configuration in which liquid fuels are mixed with air, delivered to a burner, and combusted to achieve optimum combustion at a temperature which is not deleterious to the material of the associated downstream cooking hardware.

2. Description of the Prior Art

Conventional combustion chamber and burner apparatus with which the present invention is concerned, shown generally in FIGS. 1 and 2, typically comprise an outer chamber 10 surrounding an inner chamber 12. Combustion of fuel and air mixtures take place within the inner chamber. Air from an external source is supplied to a conduit 13 at one "input" end of the outer chamber, and is caused to flow (eg., by a fan or other air mover device) through the inner chamber 12 and also through the space defined between the exterior surface of the inner chamber 12 and the interior surface of the outer chamber 10. The air which passes over the inner chamber 12 tends to cool the outer walls of inner chamber 12. When this cooling air reaches the output end (the rightmost end of the apparatus shown in FIG. 1) of the outer chamber 10 it is directed through the space defined between the concentric cylindrical exhaust sections 16 and 17.

Combustion chamber configurations of the type shown in FIGS. 1 and 2 are typically characterized by the inner chamber being of rectangular or polygonal cross-section along substantially its entire longitudinal extent, and at least one transition region 14 connecting the inner chamber with cylindrical exhaust section 17 as shown in FIG. 1. Through such transition regions 14, the inner combustion chamber is transformed from the region of rectangular or polygonal cross-section, in which combustion takes place, to the exhaust section of circular cross-section, where the products of combustion gases are to be mixed with cooling air.

One of the major difficulties with configurations of this type has been that the inner chamber must extend over a significant longitudinal extent, and oftentimes elaborate transitions are required between various inner chamber portions to convert the substantially rectangular or polygonal cross-section of the inner chamber to the circular cross-section at the exhaust section of the outer chamber.

Another problem with conventional combustion chamber configurations has been that the flame produced at the burner head takes on a long laminar shape. As a result, the flame cannot be properly or stably contained in relatively compact inner combustion chambers. Various solutions have been proposed to remedy this problem. For example, U.S. Pat. No. 4,437,831 to Brooker et al. teaches a burner head configuration for bushing out or spreading a flame. On the other hand, U.S. Pat. No. 4,094,625 to Wang et al., U.S. Pat. No. 4,023.921 to Anson, U.S. Pat. No. 3,923,251 to Flournoy and U.S. Pat. No. 3,836,315 to Shular teach shaping the flame head by introducing shaping air currents into the inner chamber at or proximal to the burner. Alternatively, U.S. Pat. No. 4,575,332 to Oppenberg et al. discloses a method of improved burning with nitrous oxide reduction involving the introduction of shaping air currents along the longitudinal extent of the inner chamber. In some applications, it has been found advantageous to provide the inner chamber with a substantial length to control the flame pattern and to accommodate the length of the flame which has been known, at times, to project up to four feet from the burner in the inner chamber even through the transition regions. Each chamber must be tailor-made for each application. This aspect of the conventional configurations is equally undesirable insofar as the heat from this extended flame pattern tends to structurally weaken, and thus significantly shorten the life of the constituent structural members.

OBJECTS OF THE INVENTION

It is therefore a primary object of the present invention to provide a combustion chamber configured to overcome all the drawbacks and deficiencies of the same type of combustion chambers known in the art today.

Another object of the present invention is to provide a combustion chamber having a configuration which will permit the input of a large range of fuels and air while blending the resultant products of combustion to a temperature which is not harmful to the hardware with which it is to be used.

Still another object of the invention is to provide a combustion chamber configuration in which the flame generated at the burner head can be stably contained in a relatively compact inner chamber and the longitudinal extent of the flame pattern will be minimized.

Yet another object of the invention is to provide a unique configuration of combustion chamber and burner head to control the temperature and velocity of the gases in the interior of the combustion chamber, while maximizing the degree of combustion of the products of combustion. It is a further object of the invention to provide a universal combustion chamber which is interchangable and can be associated with numerous pieces of cooking hardware.

BRIEF DESCRIPTION OF THE DRAWINGS

These objects and advantages of the present invention will be more fully understood when taken in consideration with the following detailed description of the invention and the appended drawings, in which.

DETAILED DESCRIPTION OF THE PREFERRED EMBODIMENT

Figure 2:
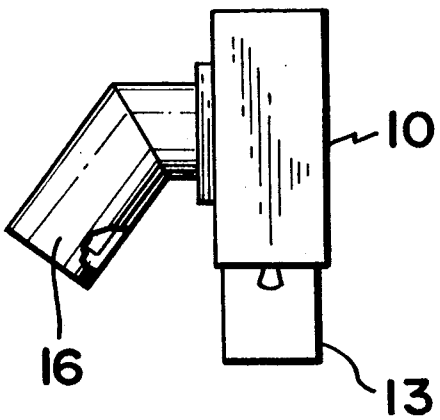
FIG. 2 (PRIOR ART)
FIGS. 1 and 2 illustrate one embodiment of a conventional combustion chamber apparatus.
Figure 1:
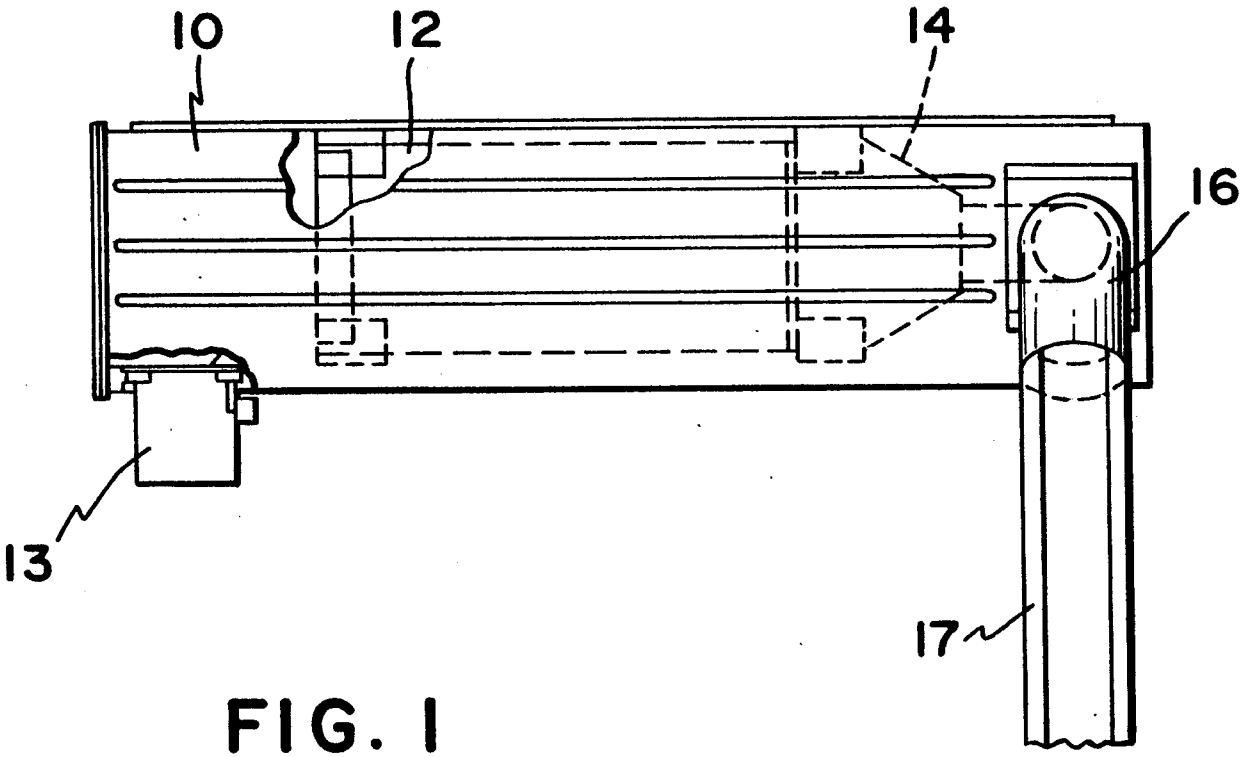
FIG. 1 (PRIOR ART)
Figure 3:
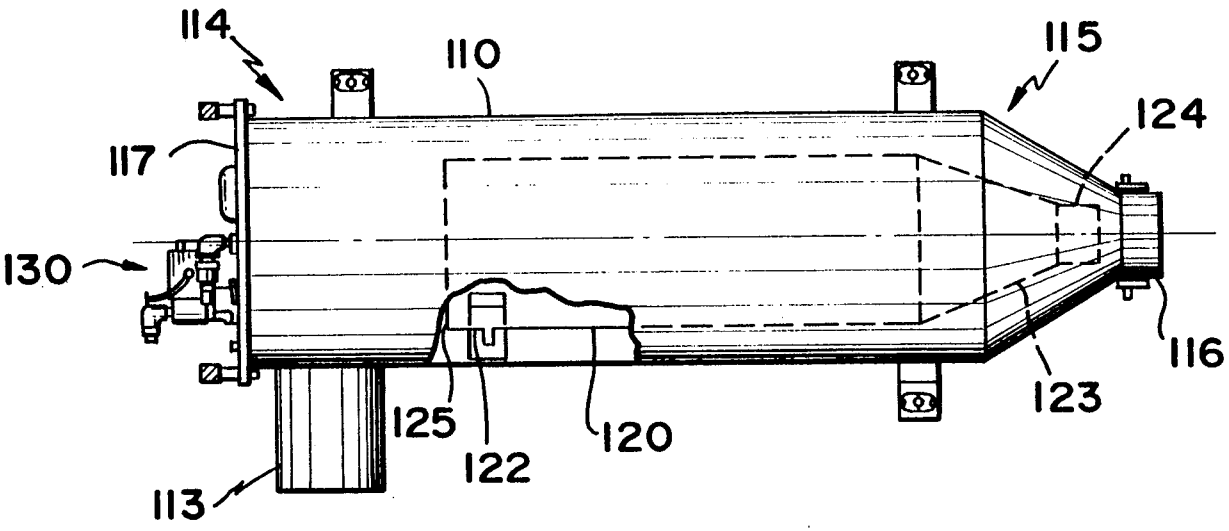
FIG. 3 illustrates a preferred embodiment of the combustion apparatus of the present invention.
Figure 4:
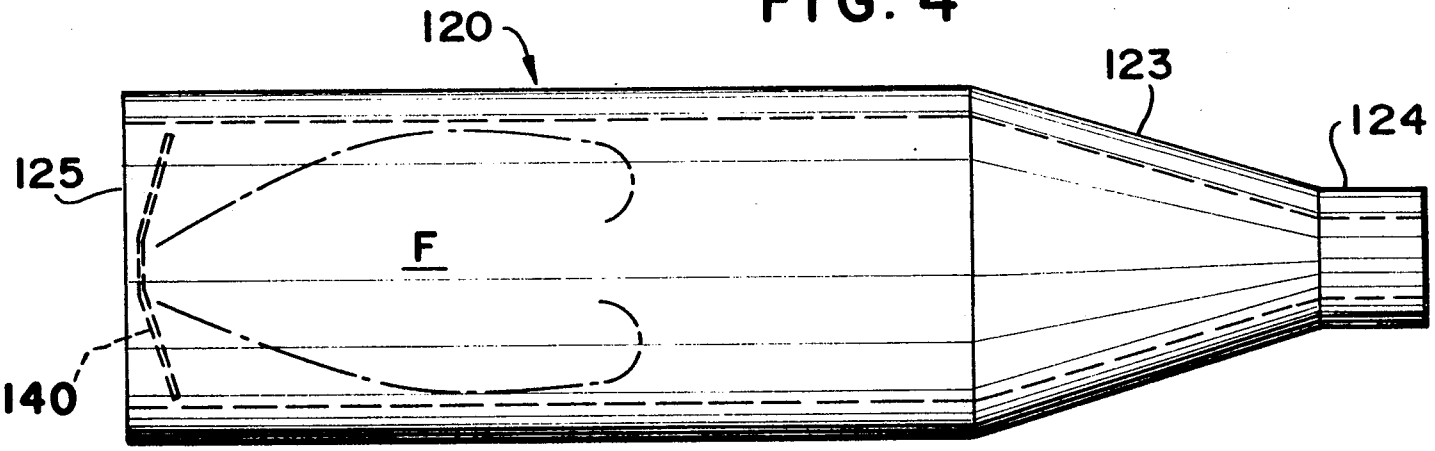
FIG. 4 illustrates in greater detail the inner chamber of the combustion apparatus of the present invention.

Referring now to FIGS. 3 and 4, a preferred embodiment of this invention is shown to include an outer chamber 110 and an inner chamber 120. The outer chamber is preferably of polygonal cross-section along its longitudinal extent, while the inner chamber is preferably of circular cross-section. Suitable bracket means 122, attached to both the inner chamber and the outer chamber at various locations along the length of the inner chamber are provided for positioning and securing the inner chamber concentrically within the outer chamber.

A conduit 113 communicates with the "input" end 114 of the outer chamber and the input end 125 of the inner chamber to supply air from an external source (not shown). Air moving means (not shown; could be simply a fan or compressor, for example) causes the air supplied from the external source to flow into the outer chamber and through the space between the inner and outer chambers to the "output" end 115 of the outer chamber. This flowing air mass performs a two-fold function. First, it cools the inner chamber. Secondly, when the combustion products reach the output end of the inner chamber (located in the vicinity of the output end of the outer chamber), the flowing air mass mixes with the hot products of combustion thereby effecting a more uniform distribution of the temperature throughout the mass moving onward to the griddle or oven through the conduit 116 attachable to the output end of the outer chamber.

As seen in FIG. 3, the inner chamber 120 is supported within the outer chamber 110 such that the air mass flowing over the inner chamber is substantially unobstructed. The leftmost or input end of the inner chamber is fluidly coupled with a source of fuel, such as liquid gas. Fittings (shown generally at 130) for a fuel source (not shown) are supported on the base 117 of the outer chamber at the input end. The configuration of the inner chamber includes a first substantially cylindrical portion 125 located proximal the input end of the outer chamber and extending over a substantial axial extent to a second somewhat truncated conical portion 123 leading from the first portion into the output end of the outer chamber. A third substantially cylindrical portion 124 extends from the second portion of the inner chamber toward the conduit 116. The third cylindrical portion of the inner chamber has a smaller diameter than the first portion of the inner chamber. In one preferred embodiment or the invention, it has been found advantageous to provide the first cylindrical portion of the inner chamber with a longitudinal extent (length) of about 12", the second portion with a longitudinal extent of about 4.75", and the third cylindrical portion with a longitudinal extent of about 1.5".

Referring now to FIG. 4 the configuration of the inner chamber 120 is depicted in greater detail, and is seen to include a flame retention head 140 disposed inside the inner chamber at a location which is proximal to the fittings and fluid couplings interconnecting with the aforementioned source of fuel. The inner wall of the inner chamber is preferably, but optionally, provided with a refractory liner. The flame retention head used in this invention is preferably chosen to be of a size which will maximize combustion while at the same time provide a more compact, more concentrated flame pattern F.

The products of combustion from the flame pattern F are compressed through the second conical portion of the inner chamber before entering the short third portion of the inner chamber. The effect of this compression is to increase the velocity of the hot gases emanating from the first portion of the inner chamber, while reducing the relative static pressure of the gases. This allows the higher pressure cooling air mass being pumped over the inner chamber to mix with the products of combustion to thereby create a blend of gases having a temperature necessary to protect the materials used in the oven or griddle.

The control of temperature can be varied by the amount of air supplied to the outer chamber. Ordinarily, by increasing the amount of air supplied directly to the burner, there is a tendency for the flame to travel further down the inner chamber, and into the conduit 116. This is an undesirable effect insofar as it places intense heat in an area which is not designed to withstand such temperatures, and it diminishes the efficiency of the burner. Thus, in conventional apparatus, any attempts to increase the burner output while maintaining a controlled temperature has been met with great difficulty. Indeed, in the known apparatus, as either excess air or burner input is increased, the conical shape of the flame becomes more ragged and the flame front moves further away from the burner nozzle.

With the apparatus of the present invention, the flame length and pattern is controlled because, as the cooling air mass flows over the flame retention head, the flame is shaped into a highly intense, somewhat tear-shaped pattern (see FIG. 4). Slots (not shown) may be provided in the retention head 140 which are patterned and/or configured to cause the flame to rotate or index around itself further mixing and thus intensifying the flame. The increase of either greater air flow or burner input does not disturb the flame pattern. The net effect is that an increase in burner input can be accompanied by an increase in delivered air thus providing more energy (increase in mass flow) while maintaining a temperature that will not damage the downline equipment. i.e., the griddle.

The proposed burner completes combustion and mixing in a lineal run of about 24". This is considered a tremendous improvement over the known apparatus, since any attempts to accomplish the same result have required at least 54" for complete combustion and fluid mixing. While the present invention has been particularly shown and described with reference to a preferred embodiment herein, it will be understood by those skilled in the art that various changes in form and detail may be made without departing from the scope or spirit of this invention.

What we claim as our invention is:

1. An improved single stage liquid fuel fired combustion apparatus for use with associated cooking equipment comprising:

an outer chamber having an inlet section, an outlet section, and a transition section positioned therebetween and joining said inlet section to said outlet section, said inlet section being of polygonal cross-section of constant dimensions along its longitudinal extent, said outlet section being of circular cross-section of constant diameter along its longitudinal extent and being of smaller cross-sectional area than that of said inlet section, said transition section being longitudinally shorter than said inlet section and said outlet section being longitudinally shorter than said transition section, an inner chamber being disposed and supported concentrically within said first chamber, said inner chamber including an inlet section, an outlet section and a truncated conical transition section positioned therebetween and joining said inlet section to said outlet section, said inlet section being of circular cross-section of constant diameter along its longitudinal extent, said outlet section being of circular cross-section of constant diameter along its longitudinal extent and being of smaller cross-sectional area than said inlet section, said transition section being longitudinally shorter than said inlet section and said outlet section being longitudinally shorter that said transition section, said inner chamber being shorter than said outer chamber and being longitudinally disposed within said outer chamber in a manner so as to provide a plenum within the inlet section of said outer chamber for distributing air therein to both the inlet section of said inner chamber and to the space between said inner chamber and said outer chamber, and so as to further provide an air flow gap between the free end of the outlet section of said inner chamber and the transition portion of said outer chamber, a cylindrical conduit perpendicularly affixed to the exterior surface of said outer chamber to introduce a stream of air into said plenum, a base assembly affixed to and closing the free end of said inlet section of said outer chamber, and a liquid fuel burner mounted on said base assembly and introducing fuel into said combustion apparatus.

* * * * *